US009340742B1

(12) United States Patent
Fang et al.

(10) Patent No.: US 9,340,742 B1
(45) Date of Patent: May 17, 2016

(54) FUEL ADDITIVE FOR IMPROVED INJECTOR PERFORMANCE

(71) Applicant: Afton Chemical Corporation, Richmond, VA (US)

(72) Inventors: Xinggao Fang, Midlothian, VA (US); Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 14/703,939

(22) Filed: May 5, 2015

(51) Int. Cl.

| | |
|---|---|
| ***C10L 1/22*** | (2006.01) |
| ***C10L 10/04*** | (2006.01) |
| ***C10L 1/18*** | (2006.01) |
| *C10L 1/222* | (2006.01) |
| *C10L 1/182* | (2006.01) |

(52) U.S. Cl.
CPC . *C10L 10/04* (2013.01); *C10L 1/18* (2013.01); *C10L 1/22* (2013.01); *C10L 1/1824* (2013.01); *C10L 1/221* (2013.01); *C10L 1/2225* (2013.01); *C10L 2200/0259* (2013.01); *C10L 2230/22* (2013.01); *C10L 2250/04* (2013.01); *C10L 2270/026* (2013.01)

(58) Field of Classification Search
CPC ..... C10L 10/04; C10L 1/22; C10L 1/18; C10L 1/221; C10L 1/2225; C10L 1/1824; C10L 2200/0259; C10L 2230/22; C10L 2250/04; C10L 2270/026
See application file for complete search history.

(56) References Cited

U.S. PATENT DOCUMENTS

| | | | | |
|---|---|---|---|---|
| 2,129,264 | A | 9/1938 | Baxter et al. | |
| 2,568,876 | A | 9/1951 | White et al. | |
| 2,886,423 | A | 5/1959 | Vitalis et al. | |
| 3,015,668 | A | 1/1962 | Kozikowski | |
| 3,027,246 | A | 3/1962 | Bartlett | |
| 3,092,474 | A | 6/1963 | Ebner | |
| 3,198,613 | A | 8/1965 | Udelhofen | |
| 3,468,640 | A | 9/1969 | Barusch et al. | |
| 3,778,371 | A | 12/1973 | Malec | |
| 4,056,531 | A | 11/1977 | Malec | |
| 4,067,698 | A | 1/1978 | Steckel | |
| 4,152,499 | A | 5/1979 | Boerzel et al. | |
| 4,171,959 | A | 10/1979 | Vartanian | |
| 4,234,435 | A | 11/1980 | Meinhardt et al. | |
| 4,248,719 | A | 2/1981 | Chafetz et al. | |
| 4,253,980 | A | 3/1981 | Hammond et al. | |
| 4,326,973 | A | 4/1982 | Hammond et al. | |
| 4,338,206 | A | 7/1982 | Hammond et al. | |
| 4,482,357 | A | 11/1984 | Hanlon | |
| 4,787,916 | A * | 11/1988 | Feldman | C10L 1/2222 44/422 |
| 5,250,174 | A | 10/1993 | Hart | |
| 5,254,138 | A | 10/1993 | Kurek | |
| 5,575,823 | A | 11/1996 | Wallace et al. | |
| 5,752,989 | A | 5/1998 | Henly et al. | |
| 5,756,428 | A | 5/1998 | Emert et al. | |
| 6,462,014 | B1 * | 10/2002 | Johnson | C11D 1/835 510/237 |
| 7,297,675 | B2 | 11/2007 | Allef et al. | |
| 7,906,470 | B2 | 3/2011 | Stevenson et al. | |
| 7,947,093 | B2 | 5/2011 | Barton et al. | |
| 7,951,211 | B2 | 5/2011 | Barton et al. | |
| 8,863,700 | B2 | 10/2014 | Fang et al. | |
| 8,894,726 | B2 | 11/2014 | Fang et al. | |
| 8,961,623 | B2 | 2/2015 | Stevenson et al. | |
| 9,062,265 | B2 | 6/2015 | Reid et al. | |
| 2003/0131527 | A1 | 7/2003 | Colucci et al. | |
| 2004/0029766 | A1 | 2/2004 | Frick et al. | |
| 2004/0167040 | A1 | 8/2004 | Dahlmann et al. | |
| 2005/0120619 | A1 | 6/2005 | Koch et al. | |
| 2006/0272597 | A1 | 12/2006 | Burrington et al. | |
| 2007/0015681 | A1 | 1/2007 | Allef et al. | |
| 2008/0113890 | A1 | 5/2008 | Moreton et al. | |
| 2010/0024286 | A1 | 2/2010 | Smith | |
| 2010/0037513 | A1 | 2/2010 | Petrucci et al. | |
| 2010/0037514 | A1 | 2/2010 | Malfer et al. | |
| 2010/0151396 | A1 | 6/2010 | Papachristo et al. | |
| 2010/0236510 | A1 | 9/2010 | Shea et al. | |
| 2011/0185626 | A1 | 8/2011 | Barton et al. | |
| 2011/0237469 | A1 | 9/2011 | Khandekar et al. | |
| 2011/0258917 | A1 | 10/2011 | Garcia et al. | |
| 2011/0302828 | A1 | 12/2011 | Fang et al. | |
| 2011/0308550 | A1 | 12/2011 | Reid | |
| 2011/0315107 | A1 | 12/2011 | Grabarse et al. | |
| 2012/0010112 | A1 | 1/2012 | Grabarse et al. | |

(Continued)

FOREIGN PATENT DOCUMENTS

| | | | |
|---|---|---|---|
| EP | 0293192 | A1 | 11/1988 |
| EP | 2033945 | A1 | 3/2009 |
| GB | 0842728 | A1 | 7/1960 |

*Primary Examiner* — Cephia D Toomer

(74) *Attorney, Agent, or Firm* — Luedeka Neely Group, P.C.

(57) ABSTRACT

The disclosure provide a sulfur-free and halogen-free synergistic additive concentrate for a fuel injected engine. The additive concentrate includes (a) an alkoxylated quaternary ammonium salt of the formula $(R^1)_nN[(R^2O)_xH]_m$, wherein $R^1$ contains from 1 to 25 carbon atoms, $R^2$ contains from 1 to 4 carbon atoms, n and m are each integers from 1 to 3, provided n+m=4, and x is an integer of from 1 to 5; and (b) a material containing a hydrogen-bonding group other than an alkyl hydroxyl group selected from the group consisting of a hydrocarbyl acid; hydrocarbyl polyacid; hydrocarbyl substituted hydroxybenzene; hydrocarbyl substituted succinic diamide, acid/amide, diacid, diester, ester/acid, amide/ester, imide; aminotriazole, and mixtures thereof, wherein the hydrocarbyl substituent has a number average molecular weight of from about 100 to about 1500, and wherein a weight ratio of (a) to (b) in the additive ranges from about 1:5 to about 1:1.

18 Claims, No Drawings

(56) References Cited

U.S. PATENT DOCUMENTS

2012/0291339 A1 11/2012 Martin et al.
2013/0031827 A1* 2/2013 Reid ..... C10L 1/22 44/386
2013/0031828 A1 2/2013 Reid et al.
2013/0104826 A1 5/2013 Burgess et al.
2013/0220255 A1 8/2013 Fang
2013/0233267 A1 9/2013 Barbour
2013/0298948 A1* 11/2013 Company ..... C11D 1/835 134/34
2013/0333650 A1* 12/2013 Fang ..... C10L 1/224 123/1 A
2014/0174390 A1 6/2014 Reid et al.
2015/0033617 A1 2/2015 Arondel et al.
2015/0252277 A1* 9/2015 Hansch ..... C10L 1/2225 44/386

* cited by examiner

FUEL ADDITIVE FOR IMPROVED INJECTOR PERFORMANCE

TECHNICAL FIELD

The disclosure is directed to fuel additives and to additive and additive concentrates that include the additive that are useful for improving the performance of fuel injected engines. In particular the disclosure is directed to a synergistic fuel additive mixture that is effective to enhance the performance of fuel injectors for internal combustion engines.

BACKGROUND AND SUMMARY

It has long been desired to maximize fuel economy, power and driveability in vehicles while enhancing acceleration, reducing emissions, and preventing hesitation. Both gasoline and diesel powered engines use dispersants to keep fuel delivering systems, such as filters and injectors, clean. However, gasoline engines and diesel engines may require different types of detergents for such purposes. The reasons for this unpredictability lie in the many differences between the fuel compositions that are suitable for such engines.

Additionally, new engine technologies require more effective additives to keep the engines running smoothly. Additives are required to keep the fuel injectors clean or clean up fouled injectors for spark-ignited and compression-ignited engines. Engines are also being designed to run on alternative renewable fuels. Such renewal fuels may include fatty acid esters and other biofuels which are known to cause deposit formation in the fuel supply systems for the engines. Such deposits may reduce or completely block fuel flow, leading to undesirable engine performance.

Also, low sulfur fuels and ultra low sulfur fuels are now common in the marketplace for internal combustion engines. A "low sulfur" fuel means a fuel having a sulfur content of 50 ppm by weight or less based on a total weight of the fuel. An "ultra low sulfur" fuel means a fuel having a sulfur content of 15 ppm by weight or less based on a total weight of the fuel. Low sulfur fuels tend to form more deposits in engines than conventional fuels, for example, because of the need for additional friction modifiers and/or corrosion inhibitors in the low sulfur fuels.

Quaternary ammonium compounds are known detergents suitable for cleaning up deposits in engines. However, the manufacturing process for such quaternary ammonium salts may be difficult and the performance of the quaternary ammonium salts may still need improvement. For example, removing undesirable ash generating components from the manufacturing process for internal quaternary ammonium salts is complicated. Furthermore, conventional quaternary ammonium salts may not be sufficiently effective for improving injector performance at relatively low treat rates. In addition, certain quaternary ammonium compounds have high HLB values and are thus are highly water soluble which causes such compounds to separate out in hydrocarbon fuels. Accordingly, there continues to be a need for fuel additives that are highly effective in cleaning up fuel injector or supply systems and maintaining the fuel injectors operating at their peak efficiency and that do not contain ash generating elements or separate out in fuels or fuel additive packages.

In accordance with the disclosure, exemplary embodiments provide a synergistic fuel additive concentrate for use in fuel injected engines, a method for cleaning fuel injectors for an internal combustion engine, a method for restoring power to a fuel injected engine, a fuel composition, a method for improving performance of fuel injectors, and a method of operating a fuel injected diesel engine. The additive concentrate includes a mixture of (a) an alkoxylated quaternary ammonium salt of the formula $(R^1)_nN[(R^2O)_xH]_m$, wherein $R^1$ comprises an alkyl group having from 1 to 25 carbon atoms, $R^2$ comprises an alkyl group having from 1 to 4 carbon atoms, n and m are each integers from 1 to 3, provided n+m=4, and at least one $R^1$ has at least 8 carbon atoms, and x is an integer ranging from 1 to 5; and (b) a hydrocarbyl compound containing a hydrogen-bonding group other than an alkyl hydroxyl group selected from the group consisting of a hydrocarbyl acid; hydrocarbyl polyacid; hydrocarbyl substituted hydroxybenzene; hydrocarbyl substituted succinic diamide, acid/amide, diacid, diester, ester/acid, amide/ester, imide; aminotriazole, and mixtures thereof, wherein the hydrocarbyl substituent has a number average molecular weight of from about 100 to about 1500, and wherein a weight ratio of (a) to (b) in the additive mixture ranges from about 1:5 to about 1:1.

Another embodiment of the disclosure provides a method of improving the injector performance of a fuel injected engine. The method includes operating the engine on a fuel composition that includes a major amount of fuel and from about 5 to about 100 ppm by weight based on a total weight of the fuel of a synergistic fuel additive. The synergistic fuel additive includes a mixture of (a) an alkoxylated quaternary ammonium salt of the formula $(R^1)_nN[(R^2O)_xH]_m$, wherein $R^1$ comprises an alkyl group having from 1 to 25 carbon atoms, $R^2$ comprises an alkyl group having from 1 to 4 carbon atoms, n and m are each integers from 1 to 3, provided n+m=4, and at least one $R^1$ has at least 8 carbon atoms, and x is an integer ranging from 1 to 5; and (b) a hydrocarbyl compound containing a hydrogen-bonding group other than an alkyl hydroxyl group selected from the group consisting of a hydrocarbyl acid; hydrocarbyl polyacid; hydrocarbyl substituted hydroxybenzene; hydrocarbyl substituted succinic diamide, acid/amide, amide/ester, diacid, diester, ester/acid, imide; aminotriazole, and mixtures thereof, wherein the hydrocarbyl substituent has a number average molecular weight of from about 100 to about 1500, and wherein a weight ratio of (a) to (b) in the additive mixture ranges from about 1:5 to about 1:1 and wherein when the synergistic additive(s) is present in the fuel, at least about 60% of the power lost during a dirty up phase of a CEC F98-08 test conducted in the absence of the synergistic additive(s) is recovered.

A further embodiment of the disclosure provides a method of operating a fuel injected engine. The method includes combusting in the engine a fuel composition containing a major amount of fuel and from about 5 to about 100 ppm by weight based on a total weight of the fuel of a synergistic fuel additive. The synergistic fuel additive includes (a) an alkoxylated quaternary ammonium salt of the formula $(R^1)_nN[(R^2O)_xH]_m$, wherein $R^1$ comprises an alkyl group having from 1 to 25 carbon atoms, $R^2$ comprises an alkyl group having from 1 to 4 carbon atoms, n and m are each integers from 1 to 3, provided n+m=4, and at least one $R^1$ has at least 8 carbon atoms, and x is an integer ranging from 1 to 5; and (b) a material containing a hydrogen-bonding group other than an alkyl hydroxyl group selected from the group consisting of a hydrocarbyl acid; hydrocarbyl polyacid; hydrocarbyl substituted hydroxybenzene; hydrocarbyl substituted succinic diamide, acid/amide, amide/ester, diacid, diester, ester/acid, imide; aminotriazole, and mixtures thereof, wherein the hydrocarbyl substituent has a number average molecular weight of from about 100 to about 1500, and wherein a weight ratio of (a) to (b) in the additive mixture ranges from about 1:5 to about 1:1.

An advantage of the fuel additive described herein is that the additive may not only reduce the amount of deposits forming on fuel injectors, but the additive may also be effective to clean up dirty fuel injectors sufficient to provide improved power recovery to the engine. The combination of components (a) and (b) in a fuel may be synergistically more effective for improving injector performance and power recovery (power restoration) than each of the components (a) and (b) alone in the fuel. Likewise, the synergistic mixture of components (a) and (b) may be more effective in minimizing deposit formation and in cleaning up injector deposits in indirect injected as well as direct injected engines than each of the components used separately.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

The mixture of components (a) and (b) of the fuel additive may be used in a minor amount in a major amount of fuel and may be added as a mixture directly to the fuel or added as a mixture component of an additive concentrate to the fuel.

Component (a)

Component (a) of the fuel additive for improving the operation of internal combustion engines may be made by a wide variety of well known reaction techniques with amines or polyamines. For example, such additive component (a) may be made by reacting a tertiary amine of the formula

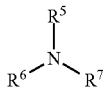

wherein each of $R^5$, $R^6$, and $R^7$ is selected from hydrocarbyl groups containing from 1 to 25 carbon atoms, with an epoxide in the presence of a carboxylic acid as described in more detail below.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as carbonyl, amido, imido, pyridyl, furyl, thienyl, ureyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

As used herein the term "ultra-low sulfur" means fuels having a sulfur content of 15 ppm by weight or less.

As used herein, the term "essentially free" means having less than 50 ppm by weight. Accordingly, a quaternary ammonium salt mixture that is sulfur-free and halogen-free is a quaternary ammonium salt mixture that is made without the use of sulfur or halogen compounds.

In one embodiment, a tertiary amine including monoamines and polyamines may be reacted with an epoxide in the presence of a carboxylic acid to provide component (a). Suitable tertiary amine compounds of the formula

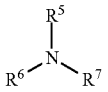

wherein each of $R^5$ $R^6$, and $R^7$ is selected from hydrocarbyl groups containing from 1 to 25 carbon atoms may be used. In one embodiment, each of $R^5$, $R^6$, and $R^7$ may have from 8 to 20 carbon atoms or from 12 to 18 carbon atoms. In the foregoing formula, only one of the $R^5$, $R^6$, and $R^7$ groups contains 8 or more carbon atoms. In another embodiment, at least one of $R^5$, $R^6$, and $R^7$ may be derived from a fatty alkyl group or a synthetic hydrocarbyl group and/or may include an alkoxy or polyalkoxy group.

The carboxylic acid may be selected from the group consisting of formic acid, acetic acid, and propanoic acid. The resulting quaternary ammonium salt is essentially free of ash generating elements such as sulfur, halides, sodium and potassium. Also, the quaternary ammonium salt may have multiple alkoxylated groups wherein in the formula $(R^1)_nN[(R^2O)_xH]_m$, x is an integer ranging from 1 to 5. In another embodiment, x is an integer selected from 1 or 2. A suitable quaternary ammonium salt has an HLB value of at least 20, such as from about 20 to about 27. If he HLB value of the quaternary ammonium salt is about 28 or higher, the quaternary ammonium salt may be too hydroscopic which may cause undesirable properties in the fuel or additive package such as separation from the fuel or additive package.

The epoxide may be selected from the group consisting of hydrocarbyl epoxides of the formula:

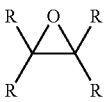

wherein each R is independently selected from H and a $C_1$ to $C_{50}$ hydrocarbyl group, and polyepoxides. Non-limiting examples of suitable epoxides that may be used as quaternizing agents may be selected from the group consisting of:

1,3-Butadiene diepoxide
Cyclohexene oxide
Cyclopentene oxide
Dicyclopentadiene dioxide
1,2,5,6-Diepoxycyclooctane
1,2,7,8-Diepoxyoctane
1,2-Epoxybutane
cis-2,3-Epoxybutane
3,4-Epoxy-1-butene
3,4-Epoxycyclohexylmethyl
3,4-epoxycyclohexanecarboxylate
1,2-Epoxydodecane
1,2-Epoxyhexadecane
1,2-Epoxyhexane
1,2-Epoxy-5-hexene
1,2-Epoxy-2-methylpropane
exo-2,3-Epoxynorbornane
1,2-Epoxyoctane
1,2-Epoxypentane
1,2-Epoxy-3-phenoxypropane
(2,3-Epoxypropyl)benzene
N-(2,3-Epoxypropyl)phthalimide
1,2-Epoxytetradecane
exo-3,6-Epoxy-1,2,3,6-tetrahydrophthalic anhydride
3,4-Epoxytetrahydrothiophene-1,1-dioxide
Isophorone oxide Methyl-1,2-cyclopentene oxide
2-Methyl-2-vinyloxirane
α-Pinene oxide
Ethylene oxide
(±)-propylene oxide
Polyisobutene oxide
cis-Stilbene oxide
Styrene oxide
Tetracyanoethylene oxide
Tris(2,3-epoxypropyl) isocyanurate and combinations of two or more of the foregoing.

If the amine contains solely primary or secondary amino groups, it is necessary to alkylate at least one of the primary or secondary amino groups to a tertiary amino group prior to the reaction with the epoxide and carboxylic acid. However, the alkylating agent may also be an epoxide.

Component (b)

Component (b) of the additive composition is, in one embodiment, is a carboxylic acid such as a fatty acid having from 8 to 25 carbon atoms or a derivative of hydrocarbyl substituted dicarboxylic anhydride, wherein the hydrocarbyl substituent has a number average molecular weight ranging from about 100 to about 1500. The derivative may be selected from a diamide, acid/amide, acid/ester, diacid, amide/ester, diester, imide, aminotriazole and mixtures thereof. Such derivative may be made from (i) hydrocarbyl substituted dicarboxylic anhydride and (ii) water, an alcohol, ammonia, guanidine, aminoguanidine, or a polyethyleneamine, wherein a molar ratio of (i) reacted with (ii) ranges from about 0.5:1 to about 2:1.

The hydrocarbyl substituted dicarboxylic anhydride may be a hydrocarbyl carbonyl compound of the formula

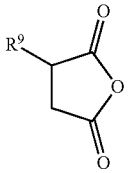

wherein $R^9$ is a hydrocarbyl group derived from a polyolefin. In some aspects, the hydrocarbyl carbonyl compound may be a polyalkylene succinic anhydride reactant wherein $R^9$ is a hydrocarbyl moiety, such as for example, a polyalkenyl radical having a number average molecular weight of from about 100 to about 1500. For example, the number average molecular weight of $R^9$ may range from about 450 to about 1300, or from about 700 to about 1000, as measured by GPC. Unless indicated otherwise, molecular weights in the present specification are number average molecular weights.

The $R^9$ hydrocarbyl moiety may comprise one or more polymer units chosen from linear or branched alkenyl units. In some aspects, the alkenyl units may have from about 2 to about 10 carbon atoms. For example, the polyalkenyl radical may comprise one or more linear or branched polymer units chosen from ethylene radicals, propylene radicals, butylene radicals, pentene radicals, hexene radicals, octene radicals and decene radicals. In some aspects, the $R^9$ polyalkenyl radical may be in the form of, for example, a homopolymer, copolymer or terpolymer. In one aspect, the polyalkenyl radical is isobutylene. For example, the polyalkenyl radical may be a homopolymer of polyisobutylene comprising from about 2 to about 60 isobutylene groups, such as from about 10 to about 20 isobutylene groups. The polyalkenyl compounds used to form the $R^9$ polyalkenyl radicals may be formed by any suitable methods, such as by conventional catalytic oligomerization of alkenes.

In component (b) the polyamine reactant may be an alkylene polyamine. For example, the polyamine may be selected from ethylene polyamine, propylene polyamine, butylenes polyamines, guanidines, aminoguanidines, and the like. In one embodiment, the polyamine is an ethylene polyamine that may be selected from ethylene diamine, piperazine, aminomethylpiperazine, diethylene triamine, triethylene tetramine, tetraethylene pentamine, and pentaethylene hexamine. A particularly useful ethylene polyamine is a compound of the formula $H_2N—((CHR^8—(CH_2)_n—NH)_m—H$, wherein $R^8$ is hydrogen, n is 1 and m is 4. The molar ratio of reactant (i) to (ii) in the reaction mixture for making component (b) may range from 0.5:1 to about 2:1. For example, a suitable molar ratio may range from about 1:1 to about 1.8:1 or from about 1.3:1 to about 1.6:1.

The hydrocarbyl substituted dicarboxylic acid, anhydride, or ester may be derived from a hydrocarbyl carbonyl compound as described above. Specific examples of hydrocarbyl carbonyl compounds include such compounds as $C_{8-18}$ alkenyl succinic anhydride, and polyisobutenyl succinic anhydride (PIBSA). In some embodiments, the PIBSA may have a polyisobutylene portion with a vinylidene content ranging from about 4% to greater than about 90%. In some embodiments, the molar ratio of the number of carbonyl groups to the number of hydrocarbyl moieties in the hydrocarbyl carbonyl compound may range from about 0.5:1 to about 5:1.

The reaction product (b) of the hydrocarbyl substituted dicarboxylic acid, anhydride, or ester and (ii) an amine compound or salt thereof of the formula

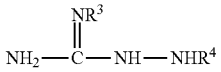

may be characterized by an FTIR spectrum having a peak intensity in a region of from about 1630 cm-1 to about 1645 cm-1 that ranges from about 5 to about 45% of peak intensities of other peak in a region of from about 1500 cm-1 to about 1800 cm-1. For example, component (b) may have a peak intensity in the region of from 1630 $cm^{-1}$ to about 1645 $cm^{-1}$ that ranges from about 5 to about 45% of peak intensities of other peaks in a region of from about 1500 $cm^{-1}$ to about 1800 $cm^{-1}$. In other embodiments, the foregoing reaction product may have a characteristic peak intensity in the range of from 1630 $cm^{-1}$ to about 1645 $cm^{-1}$ that is no more than 30%, for example no more than 25%, and typically no more than 10% of the intensity of other peaks in the range of from about 1500 $cm^{-1}$ to about 1800 $cm^{-1}$.

The hydrocarbyl acid may contain an ether group or an aromatic acid group. Hydrocarbyl polyacids may be used including, but not limited to, dimer acids and trimer acids. The hydrocarbyl substituted hydroxybenzenes may include alkylphenol, alkyl cresol, polyalkyl phenol, polyalkyl cresol, alkyl salicylic acid, alky dihydroxybenzenes, alkyltrihydroxybenzenes, alkyl Mannich compounds, and mixtures thereof.

The amount of components (a) and (b) in the fuel or fuel additive concentrate may range from a weight ratio of 1:5 to 1:1, for example from about 1:4 to about 1:1 by weight. Other useful weight ratios of (a) to (b) in a fuel may range from 1:3 to 1:1.5 and from 1.5:1 to 1:1.

In some aspects of the present application, the components (a) and (b) of the additive compositions of this disclosure may be used in combination with a fuel soluble carrier. Such carriers may be of various types, such as liquids or solids, e.g., waxes. Examples of liquid carriers include, but are not limited to, mineral oil and oxygenates, such as liquid polyalkoxylated ethers (also known as polyalkylene glycols or polyalkylene ethers), liquid polyalkoxylated phenols, liquid polyalkoxylated esters, liquid polyalkoxylated amines, and mixtures thereof. Examples of the oxygenate carriers may be found in U.S. Pat. No. 5,752,989, issued May 19, 1998 to Henly et. al., the description of which carriers is herein incorporated by reference in its entirety. Additional examples of oxygenate carriers include alkyl-substituted aryl polyalkoxylates described in U.S. Patent Publication No. 2003/0131527, published Jul. 17, 2003 to Colucci et. al., the description of which is herein incorporated by reference in its entirety.

In other aspects, the additive compositions of (a) and (b) may not contain a carrier. For example, some additive compositions of the present disclosure may not contain mineral oil or oxygenates, such as those oxygenates described above.

One or more additional optional compounds may be present in the fuel compositions of the disclosed embodiments. For example, the fuels may contain conventional quantities of cetane improvers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, organic nitrate ignition accelerators, cyclomatic manganese tricarbonyl compounds, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, and the like.

Examples of suitable optional metal deactivators useful in the compositions of the present application are disclosed in U.S. Pat. No. 4,482,357 issued Nov. 13, 1984, the disclosure of which is herein incorporated by reference in its entirety. Such metal deactivators include, for example, salicylidene-o-aminophenol, disalicylidene ethylenediamine, disalicylidene propylenediamine, N,N'-disalicylidene-1,2-diaminopropane, triazole, benzotriazole, and tolutriazole.

When formulating the fuel compositions of this application, the additive composition of (a) and (b) may be employed in amounts sufficient to reduce or inhibit deposit formation in a fuel system or combustion chamber of an engine and/or crankcase. In some aspects, the fuels may contain minor amounts of the above described additive composition that controls or reduces the formation of engine deposits, for example injector deposits in diesel engines. For example, the diesel fuels of this application may contain, on an active ingredient basis, a total amount of the additive composition of components (a) and (b) in the range of about 5 mg to about 500 mg of additive composition per Kg of fuel, such as in the range of about 10 mg to about 100 mg of per Kg of fuel or in the range of from about 20 mg to about 75 mg or in the range of 20 to 50 mg of the additive composition per Kg of fuel.

The fuels of the present application may be applicable to the operation of gasoline or diesel engines. The engines include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all gasolines, middle distillate fuels, diesel fuels, biorenewable fuels, biodiesel fuel, gas-to-liquid (GTL) fuels, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. "Biorenewable fuels" as used herein is understood to mean any fuel which is derived from resources other than petroleum. Such resources include, but are not limited to, corn, maize, soybeans and other crops; grasses, such as switchgrass, *miscanthus*, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol.

Diesel fuels that may be used include low sulfur diesel fuels and ultra low sulfur diesel fuels. A "low sulfur" diesel fuel means a fuel having a sulfur content of 50 ppm by weight or less based on a total weight of the fuel. An "ultra low sulfur" diesel fuel (ULSD) means a fuel having a sulfur content of 15 ppm by weight or less based on a total weight of the fuel. In another embodiment, the diesel fuels are substantially devoid of biodiesel fuel components.

Accordingly, aspects of the present application are directed to methods for reducing the amount of injector deposits of engines having at least one combustion chamber and one or more direct fuel injectors in fluid connection with the combustion chamber.

In some aspects, the methods comprise injecting a hydrocarbon-based compression ignition fuel comprising the additive composition of the present disclosure through the injectors of the diesel engine into the combustion chamber, and igniting the compression ignition fuel. In some aspects, the method may also comprise mixing into the diesel fuel at least one of the optional additional ingredients described above.

The fuel compositions described herein are suitable for both direct and indirect injected diesel engines. The direct injected diesel engines include high pressure common rail direct injected engines.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

Component (a) Example 1

A commercial sample of aqueous solution of trishydroxyethyl tallow ammonium salt (480 grams) was mixed with butanol (about 100 mL) and the resulting mixture heated to 125° C. to remove water. Additional butanol was then added give product as a yellowish paste in butanol (67 wt. %).

Component (b) Example 2

A component (b) was produced by mixing 640 grams of 950 number average molecular weight polyisobutylene succinic anhydride (PIBSA) with aromatic solvent 150 (380 grams) in a round bottom flask. Water (18 grams) was added to the mixture. The mixture was then heated at 90° C. for 1.5 hours while allowing excess water to evaporate under a slow nitrogen sweep of the flask. The resulting product was a brownish oil with a water content of 1381 ppm by weight.

Component (b) Example 3

A component (b) was produced from the reaction of a 950 number average molecular weight polyisobutylene succinic anhydride (PIBSA) with tetraethylenepentamine (TEPA) in a molar ratio of PIBSA/TEPA=1.6/1. PIBSA (551 g) was diluted in 200 grams of aromatic 150 solvent under nitrogen atmosphere. The mixture was heated to 115° C. TEPA was then added through an addition funnel. The addition funnel was rinsed with additional 50 grams of aromatic 150 solvent. The mixture was heated to 180° C. for about 2 hours under a slow nitrogen sweep. Water was collected in a Dean-Stark trap. The reaction mixture was further vacuum stripped to remove volatiles to give a brownish oil product. Residual TEPA in the reaction product was about 5.89 wt. % based on active material as measured by a gas chromatograph.

Component (b) Example 4

A component (b) was made similar to that of Example 3 except that the molar ratio of PIBSA/TEPA was 1.4:1 and the number average molecular weight of the PIBSA was 750 instead of 950.

Component (b) Example 5

A flask was charged with 950 molecular weight polybutenyl succinic anhydride (553 grams), aromatic solvent 150 (210 grams), aminoguanidine bicarbonate (AGBC) (79.5 grams, 1 equivalent), and toluene (145 grams). The reaction mixture was heated up to 145° C. and held for about 2 hours. No more water was removed through azeotrope distillation. A sample was removed and diluted with about an equal weight of heptane. The resulting mixture was filtered through CELITE 512 filter medium and concentrated by a rotary evaporator to give desired product as a brownish oil. An FTIR spectrum of the product showed peaks at 1724, 1689, 1637, 1588 $cm^{-1}$ with the peak at 1637 $cm^{-1}$ being the smallest.

In the following example, an injector deposit test was performed on a diesel engine using an industry standard diesel engine fuel injector test, CEC F-98-08 (DW10) as described below.

Diesel Engine Test Protocol

A DW10 test that was developed by Coordinating European Council (CEC) was used to demonstrate the propensity of fuels to provoke fuel injector fouling and was also used to demonstrate the ability of certain fuel additives to prevent or control these deposits. Additive evaluations used the protocol of CEC F-98-08 for direct injection, common rail diesel engine nozzle coking tests. An engine dynamometer test stand was used for the installation of the Peugeot DW10 diesel engine for running the injector coking tests. The engine was a 2.0 liter engine having four cylinders. Each combustion chamber had four valves and the fuel injectors were DI piezo injectors have a Euro V classification.

The core protocol procedure consisted of running the engine through a cycle for 8-hours and allowing the engine to soak (engine off) for a prescribed amount of time. The foregoing sequence was repeated four times. At the end of each hour, a power measurement was taken of the engine while the engine was operating at rated conditions. The injector fouling propensity of the fuel was characterized by a difference in observed rated power between the beginning and the end of the test cycle.

Test preparation involved flushing the previous test's fuel from the engine prior to removing the injectors. The test injectors were inspected, cleaned, and reinstalled in the engine. If new injectors were selected, the new injectors were put through a 16-hour break-in cycle. Next, the engine was started using the desired test cycle program. Once the engine was warmed up, power was measured at 4000 RPM and full load to check for full power restoration after cleaning the injectors. If the power measurements were within specification, the test cycle was initiated. The following Table 1 provides a representation of the DW10 coking cycle that was used to evaluate the fuel additives according to the disclosure.

TABLE 1

One hour representation of DW10 coking cycle.

| Step | Duration (minutes) | Engine speed (rpm) | Load (%) | Torque (Nm) | Boost air after Intercooler (° C.) |
|---|---|---|---|---|---|
| 1 | 2 | 1750 | 20 | 62 | 45 |
| 2 | 7 | 3000 | 60 | 173 | 50 |
| 3 | 2 | 1750 | 20 | 62 | 45 |
| 4 | 7 | 3500 | 80 | 212 | 50 |
| 5 | 2 | 1750 | 20 | 62 | 45 |
| 6 | 10 | 4000 | 100 | * | 50 |
| 7 | 2 | 1250 | 10 | 25 | 43 |
| 8 | 7 | 3000 | 100 | * | 50 |
| 9 | 2 | 1250 | 10 | 25 | 43 |
| 10 | 10 | 2000 | 100 | * | 50 |
| 11 | 2 | 1250 | 10 | 25 | 43 |
| 12 | 7 | 4000 | 100 | * | 50 |

Various fuel additives were tested using the foregoing engine test procedure in an ultra low sulfur diesel fuel containing zinc neodecanoate, 2-ethylhexyl nitrate, and a fatty acid ester friction modifier (base fuel). A "dirty-up" phase consisting of base fuel only with no additive was initiated, followed by a "clean-up" phase consisting of the base fuel plus additive(s). All runs were made with 8 hour dirty-up and 8 hour clean-up unless indicated otherwise. The percent power recovery was calculated using the power measurement at end of the "dirty-up" phase and the power measurement at end of the "clean-up" phase. The percent power recovery was determined by the following formula $$\text{Percent Power recovery}=(DU-CU)/DU\times 100$$

wherein DU is a percent power loss at the end of a dirty-up phase without the additive, CU is the percent power loss at the end of a clean-up phase with the fuel additive, and power is measured according to CEC F98-08 (DW10) test.

TABLE 2

| Run No. | Additives and treat rate (ppm by weight) | DU % Power Change | CU % Power Change | % power Recovery |
|---|---|---|---|---|
| 1 | (a) Reaction product of Example 1 (25 ppmw) | −4.84 | −6.47 | −34 |
| 2 | (b) Reaction product of Example 2 (75 ppmw) | −4.97 | −3.0 | 40 |
| 3 | (a) Reaction product of Example 3 (85 ppmw) | −4.45 | −3.19 | 28 |
| 4 | (b) Reaction product of Example 4 (75 ppmw) | −4.11 | −2.41 | 41 |
| 5 | (b) Reaction product of Example 5 (95 ppmw) | −6.06 | −3.06 | 50 |
| 6 | (a) + (b) Example 1 plus Example 2 (25/75 ppmw) | −3.00 | −0.43 | 86 |
| 7 | (a) + (b) Example 1 plus Example 3 (25/75 ppmw) | −2.64 | −0.70 | 73 |
| 8 | (a) + (b) Example 1 plus Example 4 (25/75 ppmw) | −2.41 | 1.92 | 180 |
| 9 | (a) + (b) Example 1 plus Example 5 (25/37.5 ppmw) | −4.44 | 1.98 | 145 |
| 10 | (a) + (b) Example 1 plus Example 5 (12.5/19 ppmw) | −4.21 | 0.32 | 108 |
| 11 | (a) + (b) Example 1 plus Oleic acid (25/28 ppmw) | −4.48 | 0.19 | 104[1] |

[1]16 hours for clean up.

As shown by the foregoing inventive Runs 6-11, a synergistic mixture containing components (a) and (b) provides significant improvement in power loss recovery compared to each of the components alone as shown in Runs 1-5. Each of the Runs 6-11 showed a synergistic increase in power recovery over what would be expected from adding the power recovery of the individual components (a) and (b).

For comparison purposes, the percent flow remaining for the compositions tested was also determined in the XUD9 engine test as shown in Table 3. The XUD9 test method is designed to evaluate the capability of a fuel to control the formation of deposits on the injector nozzles of an Indirect Injection diesel engine. Results of tests run according to the XUD9 test method are expressed in terms of the percentage airflow loss at various injector needle lift points. Airflow measurements are accomplished with an airflow rig complying with ISO 4010.

Prior to conducting the test, the injector nozzles are cleaned and checked for airflow at 0.05, 0.1, 0.2, 0.3 and 0.4 mm lift. Nozzles are discarded if the airflow is outside of the range 250 ml/min to 320 ml/min at 0.1 mm lift. The nozzles are assembled into the injector bodies and the opening pressures set to 115±5 bar. A slave set of injectors is also fitted to the engine. The previous test fuel is drained from the system. The engine is run for 25 minutes in order to flush through the fuel system. During this time all the spill-off fuel is discarded and not returned. The engine is then set to test speed and load and all specified parameters checked and adjusted to the test specification. The slave injectors are then replaced with the test units. Air flow is measured before and after the test. An average of 4 injector flows at 0.1 mm lift is used to calculate the percent of fouling. The degree of flow remaining=100−percent of fouling. The results are shown in the following table.

TABLE 3

| Example | Additives and treat rate (ppm by weight) | 0.1 mm lift flow remaining % |
|---|---|---|
| 1 | (b) Example 2 (50 ppmw) | 46 |
| 2 | (b) Example 3 (50 ppmw) | 33 |
| 3 | (a) + (b) Example 1 plus Example 2 (25/50 ppmw) | 100 |
| 4 | (a) + (b) Example 1 plus Example 3 (20/60 ppmw) | 98 |
| 5 | (a) + (b) Example 1 plus Oleic acid (25/28 ppmw) | 100 |

Example 1 was not run by itself since it was not soluble in fuel. As shown by the foregoing example, Runs 3-5 containing the synergistic combination of (a) and (b) was superior to the use of components (b) alone (Runs 1-2).

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A sulfur-free and halogen-free synergistic additive concentrate for a fuel injected engine comprising a mixture of:

(a) an alkoxylated quaternary ammonium compound having the formula $(R^1)_nN[(R^2O)_xH]_m$, wherein $R^1$ comprises an alkyl group having from 1 to 25 carbon atoms, $R^2$ comprises an alkyl group having from 1 to 4 carbon atoms, n and m are each integers from 1 to 3, provided n+m=4, and at least one $R^1$ has at least 8 carbon atoms, and x is an integer ranging from 1 to 5; and (b) a hydrocarbyl compound containing a hydrogen-bonding group other than an alkyl hydroxyl group selected from the group consisting of a hydrocarbyl acid; hydrocarbyl polyacid; hydrocarbyl substituted hydroxybenzene; hydrocarbyl substituted succinic diamide, hydrocarbyl substituted succinic acid/amide, hydrocarbyl substituted succinic diacid, hydrocarbyl substituted succinic diester, hydrocarbyl substituted succinic ester/acid, hydrocarbyl substituted succinic amide/ester, hydrocarbyl substituted succinimide; a reaction product derived from (i) a hydrocarbyl substituted dicarboxylic acid, anhydride, or ester and (ii) an amine compound or salt thereof of the formula

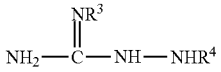

wherein $R^3$ is selected from the group consisting of hydrogen and a hydrocarbyl group containing from about 1 to about 15 carbon atoms, and $R^4$ is selected from the group consisting of hydrogen and a hydrocarbyl group containing from about 1 to about 20 carbon atoms, wherein the reaction product (2) on average has less than 1 aminotriazole group per molecule, and mixtures thereof, wherein the hydrocarbyl substituent has a number average molecular weight of from about 100 to about 1500, and wherein a weight ratio of (a) to (b) in the additive mixture ranges from about 1:5 to about 1:1.

2. The additive concentrate of claim 1, wherein additive component (a) comprises a tris-hydroxyethyl tallow amine quaternary ammonium compound.

3. The additive concentrate of claim 1, wherein additive component (a) has an HLB value ranging from about 20 to about 27.

4. The additive concentrate of claim 1, wherein component (b) comprises a hydrocarbyl substituted succinimide that is derived from tetraethylenepentamine, wherein a molar ratio of hydrocarbyl substituted dicarboxylic anhydride reacted with the tetraethylenepentamine ranges from about 1.3:1 to about 1.6:1.

5. The additive concentrate of claim 1, wherein component (b) comprises a hydrocarbyl substituted succinic diacid or a fatty acid.

6. The additive concentrate of claim 1, wherein $R^1$ has from 8 to 20 carbon atoms, n=1 and x=1 or 2.

7. A diesel fuel composition comprising a major amount of a low sulfur diesel fuel and from about 5 to about 100 ppm by weight of the additive concentrate of claim 1.

8. A method of cleaning up internal components of a fuel injector for a diesel engine comprising operating a fuel injected diesel engine on a fuel composition of claim 7.

9. A method of restoring power to a diesel fuel injected engine after an engine dirty-up phase comprising combusting in the engine a diesel fuel composition of claim 7, wherein the power restoration is measured by the following formula:

$$\text{Percent Power recovery}=(DU-CU)/DU\times 100$$

wherein DU is a percent power loss at the end of a dirty-up phase without the additive, CU is the percent power loss at the end of a clean-up phase with the fuel additive, and said power restoration is greater than 60%.

10. A method of improving the injector performance of a fuel injected engine comprising operating the engine on a fuel composition comprising a major amount of fuel and from about 5 to about 100 ppm by weight based on a total weight of the fuel of a sulfur-free and halogen-free synergistic fuel additive comprising a mixture of:

(a) an alkoxylated quaternary ammonium compound the formula $(R^1)_nN[(R^2O)_xH]_m$, wherein $R^1$ comprises an alkyl group having from 1 to 25 carbon atoms, $R^2$ comprises an alkyl group having from 1 to 4 carbon atoms, n and m are each integers from 1 to 3, provided n+m=4, and at least one $R^1$ has at least 8 carbon atoms, and x is an integer ranging from 1 to 5; and (b) a hydrocarbyl compound containing a hydrogen-bonding group other than an alkyl hydroxyl group selected from the group consisting of a hydrocarbyl acid; hydrocarbyl polyacid; hydrocarbyl substituted hydroxybenzene; hydrocarbyl substituted succinic diamide, hydrocarbyl substituted succinic acid/amide, hydrocarbyl substituted succinic diacid, hydrocarbyl substituted succinic diester, hydrocarbyl substituted succinic ester/acid, hydrocarbyl substituted succinic amide/ester, hydrocarbyl substituted succinimide; a reaction product derived from (i) a hydrocarbyl substituted dicarboxylic acid, anhydride, or ester and (ii) an amine compound or salt thereof of the formula

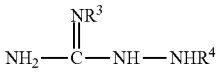

wherein $R^3$ is selected from the group consisting of hydrogen and a hydrocarbyl group containing from about 1 to about 15 carbon atoms, and $R^4$ is selected from the group consisting of hydrogen and a hydrocarbyl group containing from about 1 to about 20 carbon atoms, wherein the reaction product (2) on average has less than 1 aminotriazole group per molecule, and mixtures thereof, wherein the hydrocarbyl substituent has a number average molecular weight of from about 100 to about 1500, and wherein a weight ratio of (a) to (b) in the synergistic additive ranges from about 1:5 to about 1:1 and wherein when the synergistic additive(s) is present in the fuel, at least about 60% of the power lost during a dirty up phase of a CEC F98-08 test conducted in the absence of the synergistic additive(s) is recovered.

11. The method of claim 10, wherein the engine comprises a direct fuel injected diesel engine.

12. The method of claim 10, wherein the fuel comprises an ultra-low sulfur diesel fuel.

13. The method of claim 10, wherein additive component (a) comprises a tris-hydroxyethyl fatty amine quaternary ammonium compound having an HLB value ranging from about 20 to about 27.

14. A method of operating a fuel injected diesel engine comprising combusting in the engine a fuel composition comprising a major amount of fuel and from about 5 to about 100 ppm by weight based on a total weight of the fuel of a sulfur-free and halogen-free synergistic fuel additive comprising a mixture of:

(a) an alkoxylated quaternary ammonium compound the formula $(R^1)_nN[(R^2O)_xH]_m$, wherein $R^1$ comprises an alkyl group having from 1 to 25 carbon atoms, $R^2$ comprises an alkyl group having from 1 to 4 carbon atoms, n and m are each integers from 1 to 3, provided n+m=4, and at least one $R^1$ has at least 8 carbon atoms, and x is an integer ranging from 1 to 5; and (b) a material containing a hydrogen-bonding group other than an alkyl hydroxyl group selected from the group consisting of a hydrocarbyl acid; hydrocarbyl polyacid;

hydrocarbyl substituted hydroxybenzene; hydrocarbyl substituted succinic diamide, hydrocarbyl substituted succinic acid/amide, hydrocarbyl substituted succinic diacid, hydrocarbyl substituted succinic diester, hydrocarbyl substituted succinic ester/acid, hydrocarbyl substituted succinic amide/ester, hydrocarbyl substituted succinimide; a reaction product derived from (i) a hydrocarbyl substituted dicarboxylic acid, anhydride, or ester and (ii) an amine compound or salt thereof of the formula

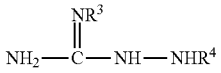

wherein $R^3$ is selected from the group consisting of hydrogen and a hydrocarbyl group containing from about 1 to about 15 carbon atoms, and $R^4$ is selected from the group consisting of hydrogen and a hydrocarbyl group containing from about 1 to about 20 carbon atoms, wherein the reaction product (2) on average has less than 1 aminotriazole group per molecule, and mixtures thereof, wherein the hydrocarbyl substituent has a number average molecular weight of from about 100 to about 1500, and wherein a weight ratio of (a) to (b) in the synergistic additive ranges from about 1:5 to about 1:1.

15. The method of claim 14, wherein additive component (a) comprises a tris-hydroxyethyl tallow amine quaternary ammonium compound having an HLB value ranging from about 20 to about 27.

16. The method of claim 14, wherein component (b) comprises a hydrocarbyl substituted succinimide that is derived from a tetraethylenepentamine, wherein a molar ratio of hydrocarbyl substituted dicarboxylic anhydride reacted with the tetraethylenepentamine ranges from about 1.3:1 to about 1.6:1.

17. The method of claim 14, wherein n=1 and $R^1$ has from 8 to 25 carbon atoms.

18. The method of claim 14, wherein x is an integer selected from 1 and 2.

* * * * *